US010071413B2

(12) United States Patent
Tian et al.

(10) Patent No.: US 10,071,413 B2
(45) **Date of Patent: *Sep. 11, 2018**

(54) DEVICE FOR ASSEMBLING PRODUCTS IN DIE

(71) Applicant: CHENGDU HOMIN TECHNOLOGY CO., LTD, Chengdu (CN)

(72) Inventors: Guofu Tian, Chengdu (CN); Jian You, Chengdu (CN); Zhouyan Wang, Chengdu (CN); Yan Zhuang, Chengdu (CN); Bin Teng, Chengdu (CN); Yi Guo, Chengdu (CN)

(73) Assignee: CHENGDU HOMIN TECHNOLOGY CO., LTD, Chengdu (CN)

( * ) Notice: Subject to any disclaimer, the term of this patent is extended or adjusted under 35 U.S.C. 154(b) by 11 days.

This patent is subject to a terminal disclaimer.

(21) Appl. No.: 15/328,029

(22) PCT Filed: May 25, 2016

(86) PCT No.: PCT/CN2016/083227

§ 371 (c)(1),
(2) Date: Jan. 22, 2017

(87) PCT Pub. No.: WO2016/188416

PCT Pub. Date: Dec. 1, 2016

(65) Prior Publication Data

US 2017/0216903 A1 Aug. 3, 2017

(30) Foreign Application Priority Data

May 28, 2015 (CN) ..... 2015 1 0281248

(51) Int. Cl.
*B21D 43/04* (2006.01)
*B21D 43/02* (2006.01)
(Continued)

(52) U.S. Cl.
CPC ..... *B21D 43/027* (2013.01); *B21D 37/10* (2013.01); *B21D 37/12* (2013.01); *B21D 39/00* (2013.01);
(Continued)

(58) Field of Classification Search
CPC ..... B21D 43/027; B21D 37/10; B21D 39/00; B21D 45/04; B21D 43/22;
(Continued)

(56) References Cited

U.S. PATENT DOCUMENTS 4,627,265 A 12/1986 Bulso, Jr. et al.
5,826,323 A * 10/1998 Walters ..... H02K 1/12 29/564.6
2011/0232076 A1* 9/2011 Matsubara ..... B21D 28/02 29/564

FOREIGN PATENT DOCUMENTS

CN 201432056 Y * 3/2010
CN 101869955 A 10/2010
(Continued)

OTHER PUBLICATIONS

English Translation of CN 201432056Y.*

*Primary Examiner* — Sunil K Singh
*Assistant Examiner* — Yasir Diab
(74) *Attorney, Agent, or Firm* — Gokalp Bayramoglu

(57) ABSTRACT

The present invention discloses a device for assembling products in a die. The device comprises a pushing portion and an assembling portion. The pushing portion comprises a pushing block (11), a pushing spring (10) and a pushing wedge (9) wherein the pushing block (11) is connected with the pushing spring (10), the pushing wedge (9) is arranged above the pushing block (11) and is in wedge-shaped connection with the pushing block (11). The assembling portion comprises an assembling wedge (6), a transmission wedge (4) and an assembling male die (5), wherein the
(Continued)

transmission wedge (4) is arranged above the assembling male die (5) in wedge-shaped connection and both of them are arranged in the lower die base (2), the assembling wedge (6) is arranged above the transmission wedge (4) in wedge-shaped connection while in contact.

4 Claims, 1 Drawing Sheet

(51) Int. Cl.
*B21D 37/10* (2006.01)
*B21D 39/00* (2006.01)
*B21D 45/04* (2006.01)
*B21D 37/12* (2006.01)

(52) U.S. Cl.
CPC ..... *B21D 45/04* (2013.01); *Y10T 29/5138* (2015.01); *Y10T 29/5143* (2015.01)

(58) Field of Classification Search
CPC ..... Y10T 156/1056; Y10T 156/107; Y10T 29/5192; Y10T 29/5138; Y10T 29/5143; H01F 41/02; H01F 41/0206; H01F 41/0213; H01F 41/022; H01F 41/0226; H01F 41/0233; H01F 41/024; H01F 41/0246; H01F 41/0253; H01F 41/026; H02K 15/02; H02K 15/022; H02K 15/024; H02K 15/026; H02K 15/028
USPC ..... 83/463, 464, 435.25, 437.6
See application file for complete search history.

(56) References Cited

FOREIGN PATENT DOCUMENTS

| | | | | |
|---|---|---|---|---|
| CN | 201900179 | U | * | 7/2011 |
| CN | 102513452 | A | * | 6/2012 |
| CN | 103008484 | A | | 4/2013 |
| CN | 104841783 | A | | 8/2015 |
| CN | 104858308 | A | | 8/2015 |
| CN | 204672812 | U | | 9/2015 |
| CN | 105834300 | A | * | 8/2016 |
| KR | 20050121774 | A | | 12/2005 |

* cited by examiner

DEVICE FOR ASSEMBLING PRODUCTS IN DIE

CROSS REFERENCE TO RELATED APPLICATIONS

This application is the national phase entry of International Application No. PCT/CN2016/083227, filed on May 25, 2016, which is based upon and claims priority to Chinese Patent Application No. 201510281248.4 filed on May 28, 2015, the entire contents of which are incorporated herein by reference.

TECHNICAL FIELD

The present invention relates to production equipment, in particular to a device for assembling products in a die.

BACKGROUND ART

Under the conditions of the prior art, small pans are produced in a form of single line and are concentratively assembled finally in a form of artificial assembly. When products are produced in a large batch, such production mode not only causes low production efficiency and brings large labor intensity for workers, but also is likely to damage parts in the assembly process.

SUMMARY OF INVENTION

Technical Problem

The present invention aims to overcome the defects of the prior art and provides a device for assembling products in a die, which is simple in structure and convenient to use, is applicable to online assembly of products, realizes automatic assembly of products and improves the production efficiency.

SOLUTION TO THE PROBLEM

Technical Solution

The objective of the present invention is realized by the following technical solution: a device for assembling products in a die comprises a pushing portion and an assembling portion. The pushing portion comprises a pushing block, a pushing spring and a pushing wedge, wherein the pushing block is connected with the pushing spring, the pushing wedge is arranged above the pushing block and is in wedge-shaped connection with the pushing block, the pushing wedge is arranged below an upper die base, and the pushing block and the pushing spring are arranged above a lower die base; the assembling portion comprises an assembling wedge, a transmission wedge and an assembling male die, wherein the transmission wedge is in wedge-shaped connection with the assembling male die, the transmission wedge and the assembling male die are arranged in the lower the base, the transmission wedge is arranged above the assembling male die, the assembling wedge is arranged above the transmission wedge, the assembling wedge is in wedge-shaped connection with the transmission wedge while in contact, and the assembling wedge is arranged below the upper die base.

The transmission wedge is connected with a wedge resetting spring.

The assembling male die is connected to a male die resetting spring which is arranged below the assembling male die and located in the lower die base.

A blanking male die is arranged below the upper die base.

BENEFICIAL EFFECTS OF THE INVENTION

Beneficial Effects

The present invention has the following advantages:

1. the device can realize the automation of production, improve the production efficiency, relieve the labor intensity for workers and improve the yield of products;

2. the device is simple in structure, convenient to use and convenient for automatic control and has the advantages of control flexibility, high precision and the like;

4. the assembling male die is advantageous for automatic resetting by connecting with the male die resetting spring and is convenient for automatic production, such that there is no need for personnel to operate the assembling male die to reset, and the labor intensity of workers is relieved;

4. the transmission wedge is advantageous for automatic resetting by connecting with the wedge resetting spring and is convenient for automatic production, such that there is no need for personnel to operate the transmission wedge to reset, and the labor intensity of workers is relieved; and 5. a transmission direction of movement can be changed by using wedge connection, the movement in a vertical direction is changed into the movement in a horizontal direction, such that the device can be used conveniently with high connection rigidity and high transmission precision, and therefore the assembly precision of products is high.

BRIEF DESCRIPTION OF THE DRAWINGS

Description of the Drawings

Figure 1:
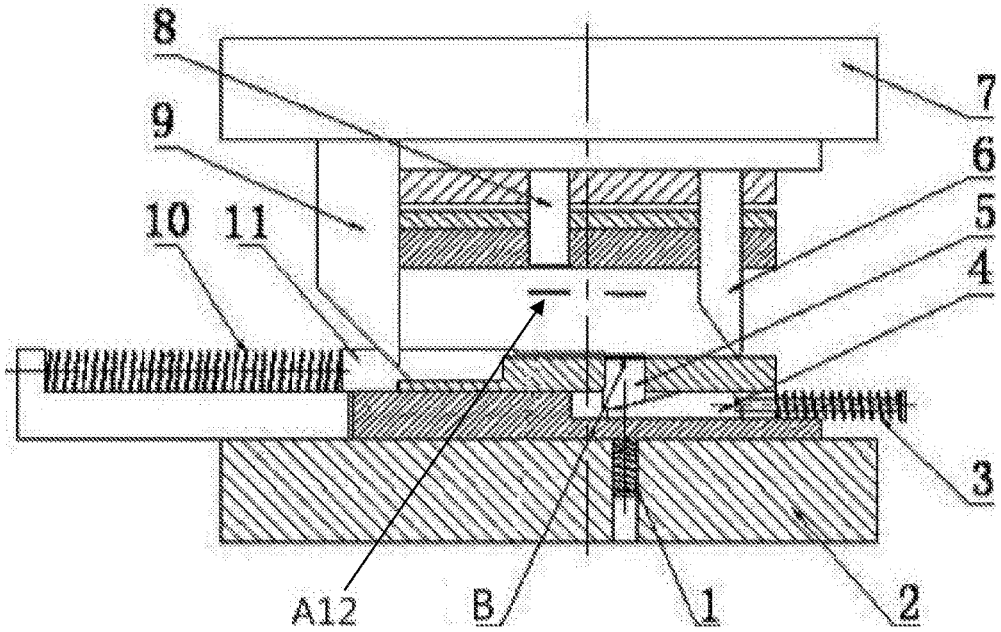
Figure 2:
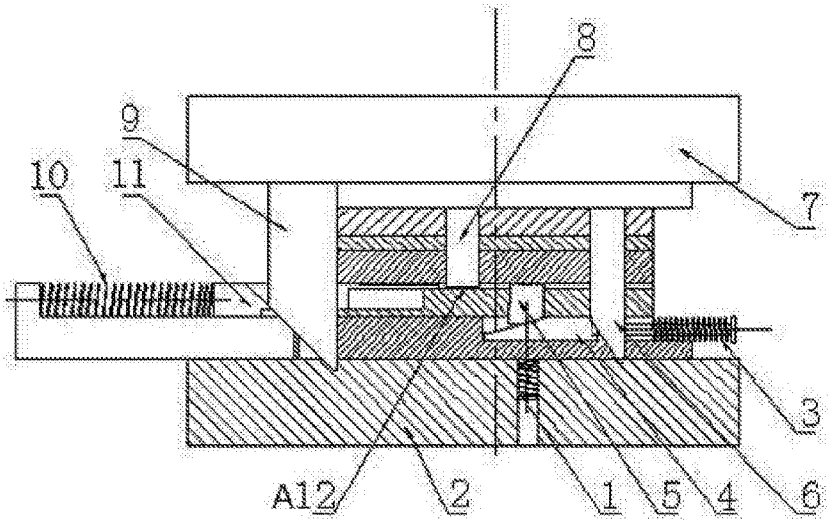

FIG. 1 is a schematic drawing of a die opening structure of the device for assembling products in a die;

FIG. 2 is a schematic drawing of a die closing structure of the device for assembling products in a die;

and in drawings, male die resetting spring 1, lower die base 2, wedge resetting spring 3, transmission wedge 4, assembling male die 5, assembling wedge 6, upper die base 7, blanking male die 8, pushing wedge 9, pushing spring 10, pushing block 11 and part A12 are marked.

DETAILED DESCRIPTION OF INVENTION

Implementations of the Present Invention

The present invention will be further described as below in conjunction with the drawings. The protection scope of the present invention is not limited to the following content:

As shown in FIG. 1 and FIG. 2, a device for assembling products in a die comprises a pushing portion and an assembling portion. The pushing portion comprises pushing block 11, pushing spring 10 and pushing wedge 9, wherein pushing block 11 is connected with pushing spring 10, pushing wedge 9 is arranged above pushing block 11 and is in wedge-shaped connection with pushing block 11, pushing wedge 9 is arranged below upper die base 7, and pushing block 11 and pushing spring 10 are arranged above lower die base 2. In this embodiment, blanking male die 8 is arranged below upper die base 7. The assembling portion comprises assembling wedge 6, transmission wedge 4 and assembling male die 5, wherein transmission wedge 4 is in wedge-shaped connection with assembling male die 5, and transmission wedge 4 and assembling male die 5 are arranged in lower die base 2, and transmission wedge 4 is arranged above assembling male die 5. In this embodiment, transmission wedge 4 is connected to wedge resetting spring 3, assembling male die 5 is connected to male die resetting spring 1, male die resetting spring 1 is arranged below assembling male die 5 and located in lower die base 2, assembling wedge 6 is arranged above transmission wedge 4, assembling wedge 6 is in wedge-shaped connection with transmission wedge 4 while in contact, and assembling wedge 6 is arranged below upper die base 7.

A working process of the present invention is as follows; part A12 and part B are machined by stamping two different strip blanks in one equipment.

As shown in FIG. 1, machined part A12 is located below blanking male die 8, and the part B is located above assembling male die 5. At this moment, part A12 machined in the previous procedure is pushed to a position above assembling male die 5 and a position below part B by pushing block 11 which is at a right limit position.

When parts are stamped by equipment, upper die base 7 drives assembling wedge 6, blanking male die 8 and pushing wedge 9 to move downwards in synchronization with a stamping mechanism, pushing wedge 9 pushes pushing block 11 to move leftwards against the thrust of pushing spring 10, upper die base 7 pushes the strip blanks and part A12 and part B on the strip blanks downwards, assembling wedge 6 pushes transmission wedge 4 to move leftwards against the tension of wedge resetting spring 3, and transmission wedge 4 pushes assembling male die 5 to move upwards against the tension of male die resetting spring 1.

As shown in FIG. 2, by designing the wedge angle, when pushing wedge 9 pushes pushing block 11 to move to a left limit position, blanking male die 8 pushes part A12 on the strip blank out of the strip blank and to a position at the right side of pushing block 11, assembling male die 5 is at an upper limit position under the action of transmission wedge 4, and part A12 machined in the previous procedure and part B are assembled together under the action of pressure.

At this moment, the stamping mechanism accomplishes stamping of the strip blanks and prepares for resetting upper die base 7 drives assembling wedge 6, blanking male die 8 and pushing wedge 9 to move upwards in synchronization with the stamping mechanism, pushing wedge 9 is disconnected from pushing block 11, pushing block 11 moves leftwards under the thrust of pushing spring 10, assembling wedge 6 is separated from transmission wedge 4, transmission wedge 4 moves rightwards under the tension of wedge resetting spring 3 and enables transmission wedge 4 to be separated from assembling male die 5, and assembling male die 5 moves downwards under the tension of male die resetting spring 1. When pushing block 11 is at a right limit position, the strip blank is conveyed by a length of one feed, then referring to FIG. 1.

What is claimed is:

1. A device for assembling products in a die, comprising: a pushing portion and an assembling portion; wherein the pushing portion comprises a pushing block, a pushing spring and a pushing wedge, wherein the pushing block is connected with the pushing spring, the pushing wedge is arranged above the pushing block and is in a wedge-shaped connection with the pushing block, the pushing wedge is arranged below an upper die base, and the pushing block and the pushing spring are arranged above a lower die base, wherein the upper die base pushes the wedge and the wedge pushes the pushing block to move leftwards towards the pushing spring against the thrust of the pushing spring; the assembling portion comprises an assembling wedge, a transmission wedge and an assembling male die, wherein the transmission wedge is in the wedge-shaped connection with the assembling male die, the transmission wedge and the assembling male die are arranged in the lower die base, the transmission wedge is arranged below the assembling male die, the assembling wedge is arranged above the transmission wedge, the assembling wedge is in the wedge-shaped connection with the transmission wedge while in contact, wherein the upper die base pushes the assembling wedge downward and the assembling wedge pushes the transmission wedge to move leftwards away from the wedge resetting spring against the tension of the wedge resetting spring; wherein the wedge-shaped connection between the assembling wedge and the transmission wedge, while in contact, allows conversion of device portion movement in a vertical direction into device portion movement in a horizontal direction, and the assembling wedge is arranged below the upper die base.

2. The device for assembling products in a die according to claim 1, wherein the transmission wedge is connected to a wedge resetting spring.

3. The device for assembling products in a die according to claim 1, wherein the assembling male die is connected to a male die resetting spring which is arranged below the assembling male die and located in the lower die base.

4. The device for assembling products in a die according to claim 1, wherein a blanking male die is arranged below the upper die base.

* * * * *